US008690737B2

(12) United States Patent
Van Straaten

(10) Patent No.: US 8,690,737 B2
(45) Date of Patent: Apr. 8, 2014

(54) EXERCISE MACHINE

(76) Inventor: Willem Johannes Van Straaten, Johannesburg (ZA)

( * ) Notice: Subject to any disclaimer, the term of this patent is extended or adjusted under 35 U.S.C. 154(b) by 278 days.

(21) Appl. No.: 13/103,404

(22) Filed: May 9, 2011

(65) Prior Publication Data

US 2011/0281690 A1 Nov. 17, 2011

(30) Foreign Application Priority Data

May 12, 2010 (ZA) ..... 2010/01035

(51) Int. Cl.
*A63B 22/04* (2006.01)
*A63B 22/02* (2006.01)

(52) U.S. Cl.
USPC ..... 482/52; 482/57

(58) Field of Classification Search
CPC ..... A63B 22/0664; A63B 22/001; A63B 2022/067; A63B 21/225; A63B 22/0015; A63B 22/0007; A63B 22/0012
USPC ..... 482/52, 54, 57
See application file for complete search history.

(56) References Cited

U.S. PATENT DOCUMENTS

| | | | | |
|---|---|---|---|---|
| 5,971,892 | A * | 10/1999 | Lee | 482/52 |
| 6,152,859 | A * | 11/2000 | Stearns | 482/52 |
| 6,196,948 | B1 * | 3/2001 | Stearns et al. | 482/52 |
| 6,485,395 | B1 * | 11/2002 | Stearns et al. | 482/57 |
| 7,121,984 | B1 * | 10/2006 | Hong | 482/52 |
| 7,201,704 | B2 * | 4/2007 | Stearns | 482/52 |
| 7,226,392 | B2 * | 6/2007 | Hong | 482/52 |
| 7,637,848 | B1 * | 12/2009 | Chang | 482/51 |
| 2009/0239714 | A1 * | 9/2009 | Sellers | 482/52 |

* cited by examiner

*Primary Examiner* — Oren Ginsberg
*Assistant Examiner* — Rae Fischer
(74) *Attorney, Agent, or Firm* — Wenderoth, Lind & Ponack, L.L.P.

(57) ABSTRACT

A dual mode exercise machine which can work in a stepping mode, or in an elliptical mode, and which has an interlock mechanism which ensures that the machine cannot be placed in a condition in which neither mode is engaged.

6 Claims, 10 Drawing Sheets

EXERCISE MACHINE

BACKGROUND OF THE INVENTION

This invention relates to an aerobic exercise machine.

Different types of machines exist for aerobic exercises and for muscle conditioning based on movement which is referred to, perhaps somewhat loosely, as elliptical. Some of these machines however offer only one exercise. The monotony of a single exercise can result in boredom and cause a user to discontinue the exercise. Also, repeated performance of one type of exercise is less effective than engaging in a variety of exercises.

A few so-called "dual mode" exercise machines have been developed. These machines offer a second type of exercise in addition to exercise based on the so-called elliptical movement. Usually though this is at the cost of complex design and additional expenditure. A further aspect is that a somewhat laborious process is required when reconfiguring parts of the machine in order to change from one exercise mode to another.

For example, a machine referred to as "SEG-1682—Two-in-one Elliptical and Stepper" (cf http://www.thane.com/service.php), has a footplate which is mounted to a slider. In a stepper mode the footplate is locked to a cross-member by means of a screw. Upon rotation of a crank the footplate is moved up and down in a vertical mode.

A similar construction is embodied in a machine, also from SEG, labelled "ED-3060—Motorised Elliptical Tread". To place the machine in an elliptical mode a screw is loosened and a footplate is moved along a slider to a defined position at which the slider is locked against movement. Rotation of a crank then causes the footplate to move in an elliptical fashion. The crank is permanently connected to the slider.

A so-called "Street Bike" (origin unknown), (which is a mobile device and not a stationary exercise machine), includes a pedal mechanism wherein up/down movement imparted by a user to footpads is translated into rotational movement of a crank which has arms which are slidingly engaged with the footpads. This "Street Bike" offers only one mode of use.

An object of the present invention is to provide a dual mode exercise machine which is relatively inexpensive and which has a simple construction to facilitate switching from a first exercise mode to a second exercise mode. An additional important aspect of the invention is that the exercise machine cannot readily be placed in a situation in which neither mode is engaged. This enhances the safety of use of the exercise machine.

In this specification a first exercise mode is also referred to as a "stepping" mode. A second exercise mode results upon rotation of a crank around an axis. Movement is transferred from the crank via a footplate to a user. This movement may be circular or partly circular and, for the sake of convenience and in order to distinguish one mode from the other, is referred to as "elliptical" movement.

SUMMARY OF INVENTION

The invention provides an exercise machine which includes ground-engaging support structure, a pedal arrangement which includes first and second crank members which are mounted to the support structure for rotational movement about a first axis, first and second handles which are mounted to the support structure for pivotal movement about a second axis, first and second cross members which are respectively pivotally connected to the first and second handles, first and second foot-engaging structures, mounted respectively to the first and second cross members, which are respectively engaged with, and which are movable relative to, the first and second crank members, first locking means operative to lock the first and second handles to the support structure thereby to inhibit pivotal movement of the handles about the second axis so that, upon rotational movement of the pedal arrangement, the first and second foot-engaging structures are movable to provide a first exercise action and, in response thereto, the first and second cross members are pivotally movable relative to the first and second handles, and second locking means operative to lock the first and second crank members to the first and second cross members respectively, so that, upon rotational movement of the pedal arrangement, the first and second foot-engaging structures are movable to provide a second exercise action and, in response thereto, the first and second handles are pivotally movable about the second axis.

The first exercise action may be a stepping action and the second exercise action may be an elliptical action.

Preferably the exercise machine includes a resistance device which acts at least against rotational movement of the pedal arrangement.

The exercise machine may include first and second guides which respectively retain the first and second foot-engaging structures in engagement with the first and second crank members.

Preferably the first and second locking means include an interlock mechanism which prevents the first and the second locking means from being rendered inoperative at the same time.

The interlock mechanism may for example include an actuator which is engageable with the first locking means, when operative, and which is then actuable thereby to render the first locking means inoperative and which is only disengageable from the first locking means when the first locking means is operative, and which is engageable with the second locking means, when the second locking means is operative, and which is then operable to render the second locking means operative and which is only disengageable from the second locking means when the second locking means is operative.

BRIEF DESCRIPTION OF THE DRAWINGS

The invention is further described by way of example with reference to the accompanying drawings in which.

DESCRIPTION OF PREFERRED EMBODIMENT

Figure 1:
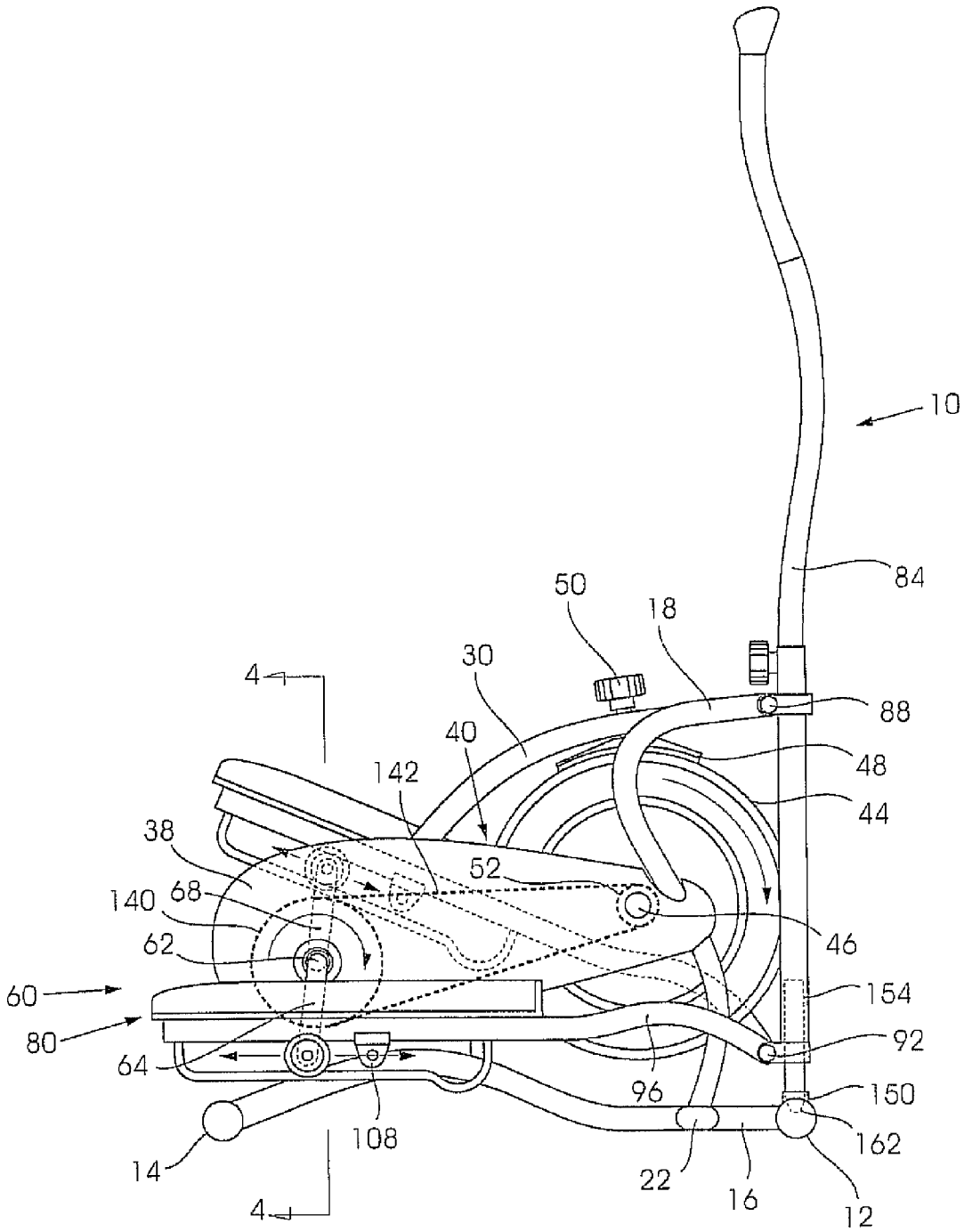
FIG. 1 is a side view of an exercise machine according to the invention in a first, stepper mode of operation.
Figure 3:
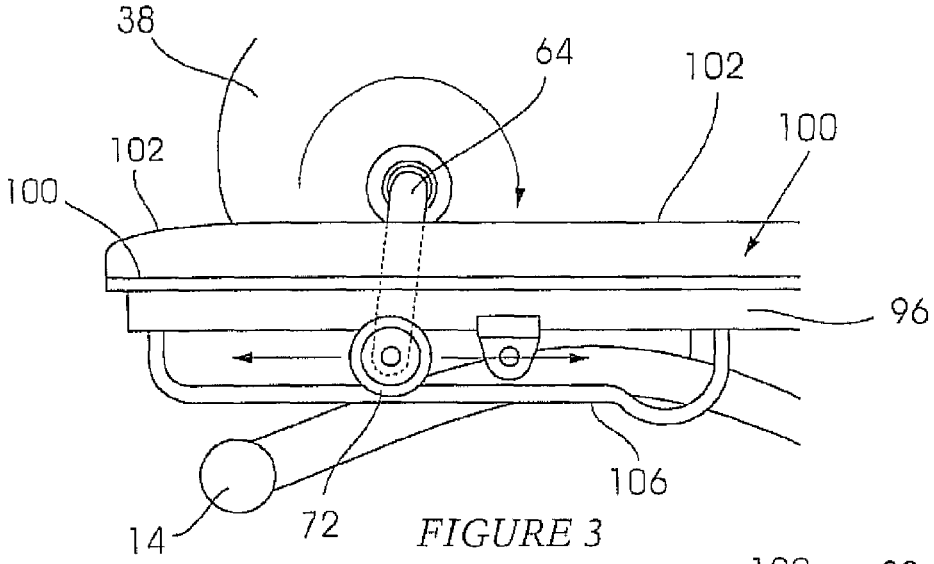
FIG. 3 shows part of the exercise machine in FIG. 1 on an enlarged scale.
Figure 4:
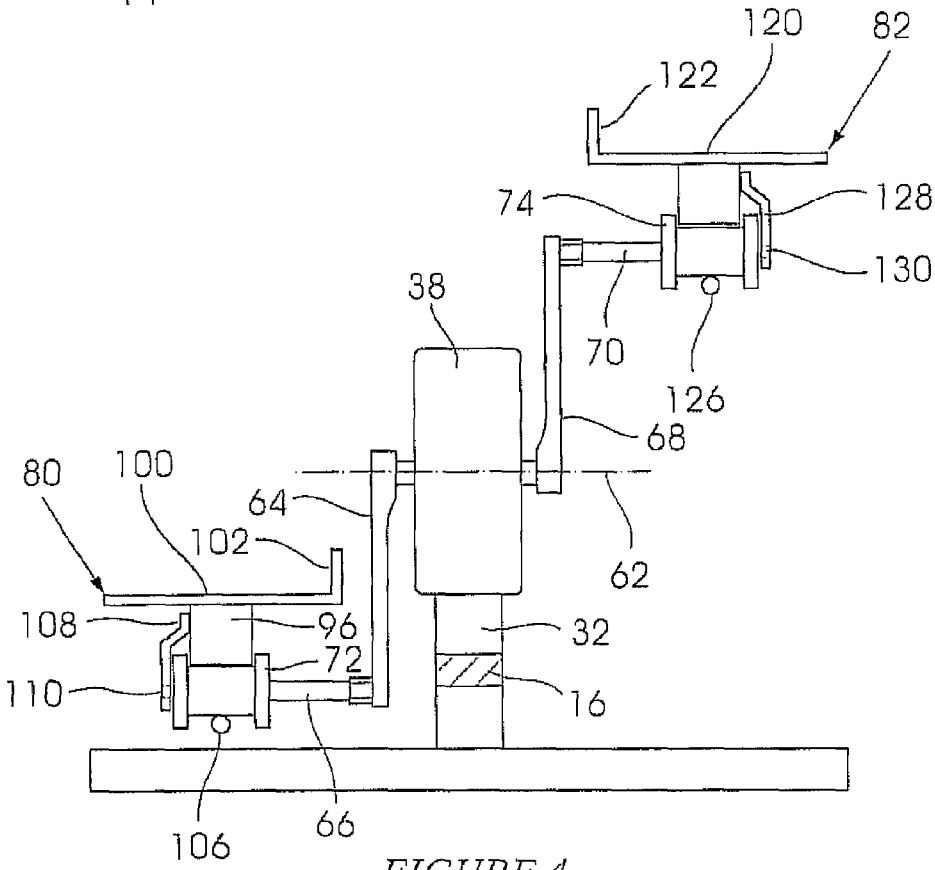
FIG. 4 is a view in cross-section of the machine taken on a line 4-4 in FIG. 1.

FIG. 1 of the accompanying drawings is a side view of an exercise machine 10 according to the invention in a first mode of operation. FIG. 4 is a view in cross-section of the machine taken on a line 4-4 in FIG. 1, and FIG. 3 illustrates in enlarged detail a portion of the machine in FIG. 1.

Figure 5:
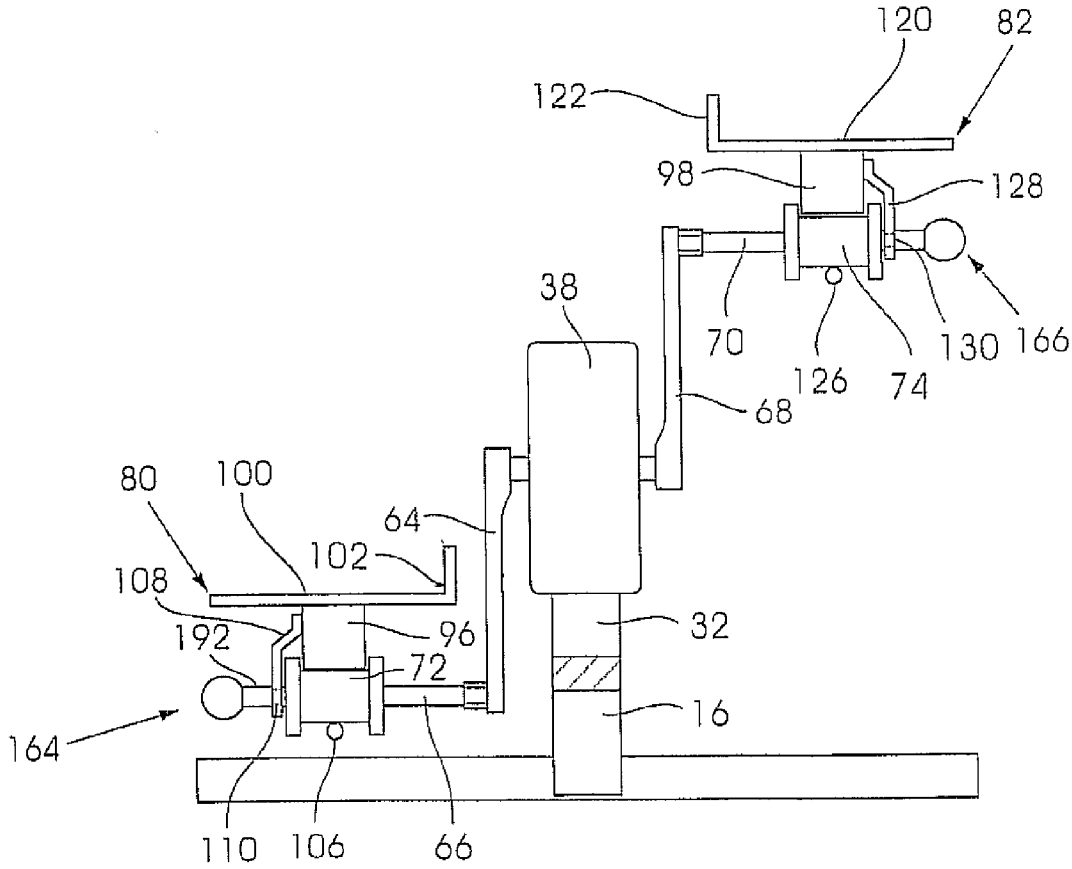
FIG. 5, which is similar to FIG. 4, is a view in cross-section of the machine taken on a line 5-5 in FIG. 2.
Figure 6:
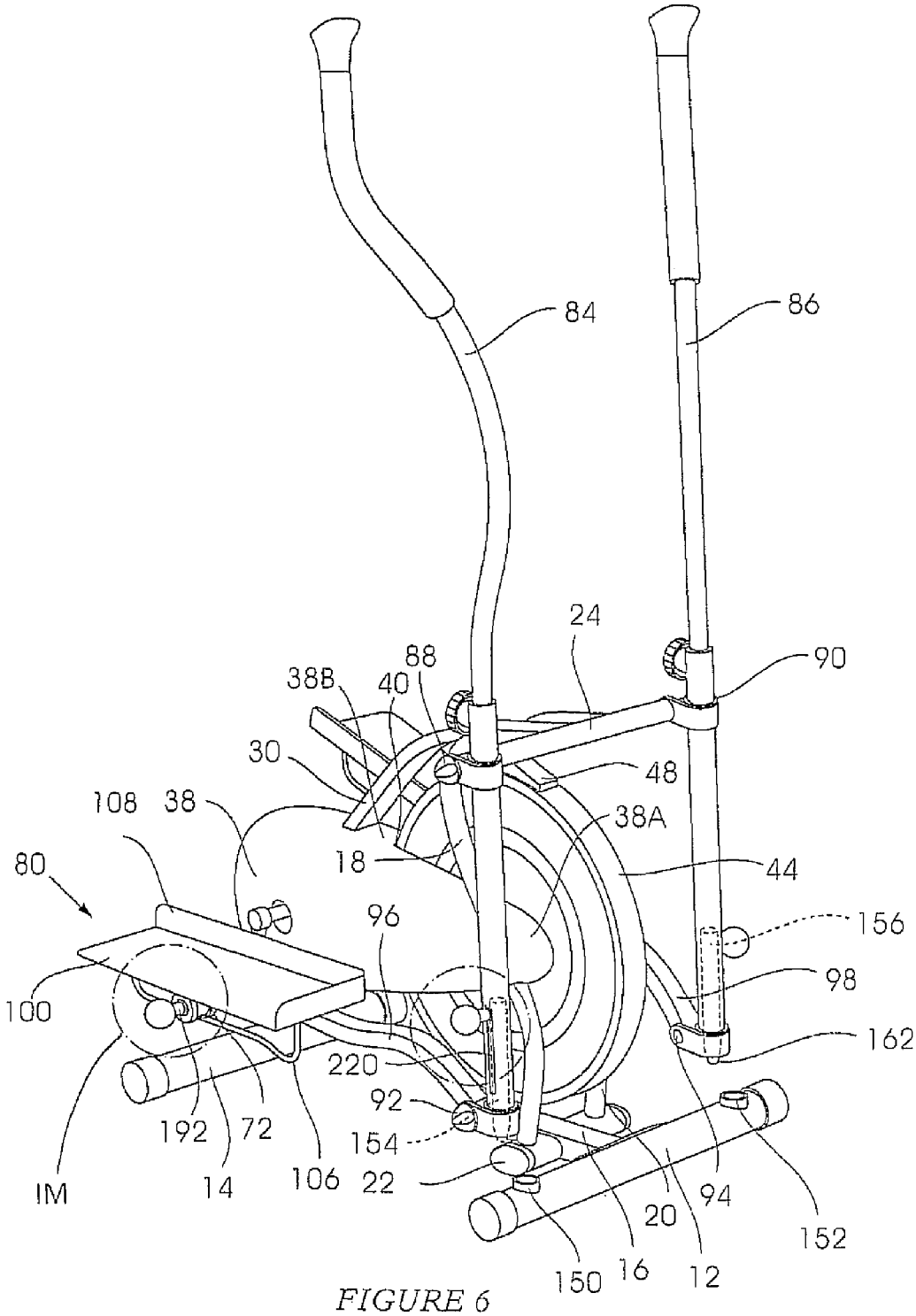
FIG. 6 is a perspective view from a front side of the machine in the FIG. 2 mode.
Figure 7:
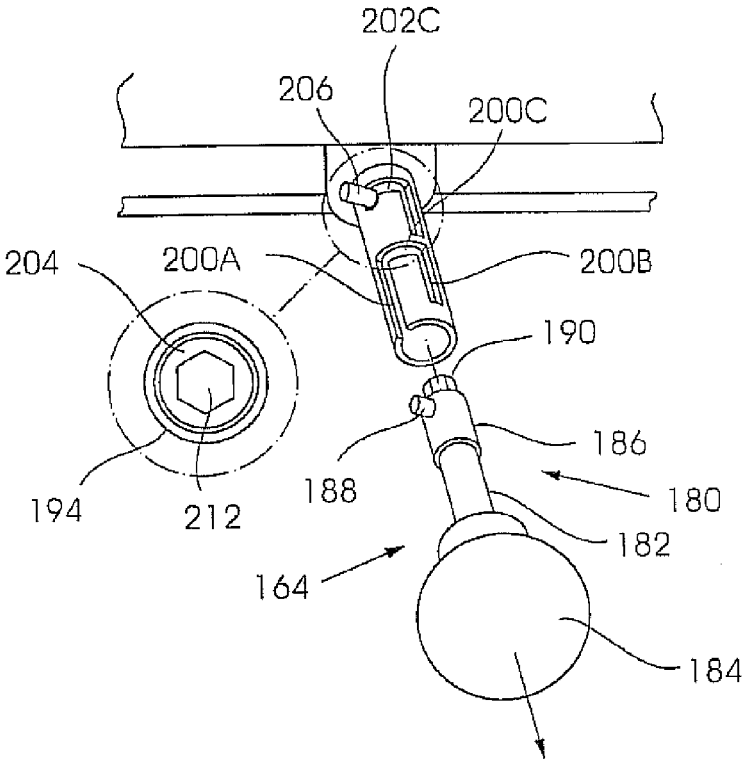
FIGS. 7 to 11 illustrate the use of an actuator key which is part of an interlock mechanism, in connection with foot-engaging structure, in changing the exercise machine from the stepper mode to the elliptical mode.

Front and rear base members 12 and 14 respectively are located at extremities of a centrally positioned curved spine 16—see FIG. 6. Curved supports 18 and 20 respectively extend upwardly from a small strut 22, which is fixed to the spine close to the front base member 12. A crosspiece 24 is fixed to upper ends of the curved supports 18 and 20 (see FIG. 6). A curved support 30 is fixed between the crosspiece 24 and a pedestal 32 (FIG. 6) which extends upwardly from the spine 16—see FIG. 5. The members 12 and 14, the spine 16, the supports 18 and 20, and the support 30, make up a stable support structure to which the various components of the machine are connected.

An elongate, roughly oval, box-like structure 38 is fixed to the pedestal 32 (FIGS. 1 and 5). The structure 38 has two opposing sections 38A and 38B with a gap 40 between them, which are fixed to the supports 18, 20 respectively (the section 38B is largely hidden from view in FIG. 6). A flywheel 44 is positioned in the gap 40 and is mounted for rotation about an axle 46. A friction brake pad 48 (FIG. 1) which is mounted to the support 30 can be moved by means of a screw device 50 to bear with variable force on an outer peripheral surface of the flywheel so that the force which is required to rotate the flywheel can be adjusted.

A cog 52, shown in dotted outline in FIG. 1, is mounted to the axle 46.

Optionally, frame components, not shown, are positioned between the supports 18 and 20 and a lower end of the support 30. The frame components are then fixed to the pedestal 32, in order to brace the pedestal.

A pedal arrangement 60 is mounted for rotation about an axis 62 which traverses the pedestal 32 (FIG. 1). The pedal arrangement (see FIG. 5) includes a first crank member 64 which terminates in a stub axle 66 and a second crank member 68, on an opposed side of the pedestal 32, which terminates in a stub axle 70. Each stub axle carries a respective roller 72 and 74. The stub axle 66 and accompanying roller 72 are positioned below foot-engaging structure 80. The roller 74 is below foot-engaging structure 82. The arrangements are similar and thus the arrangement of the foot-engaging structure 80 only is described.

Figure 2:
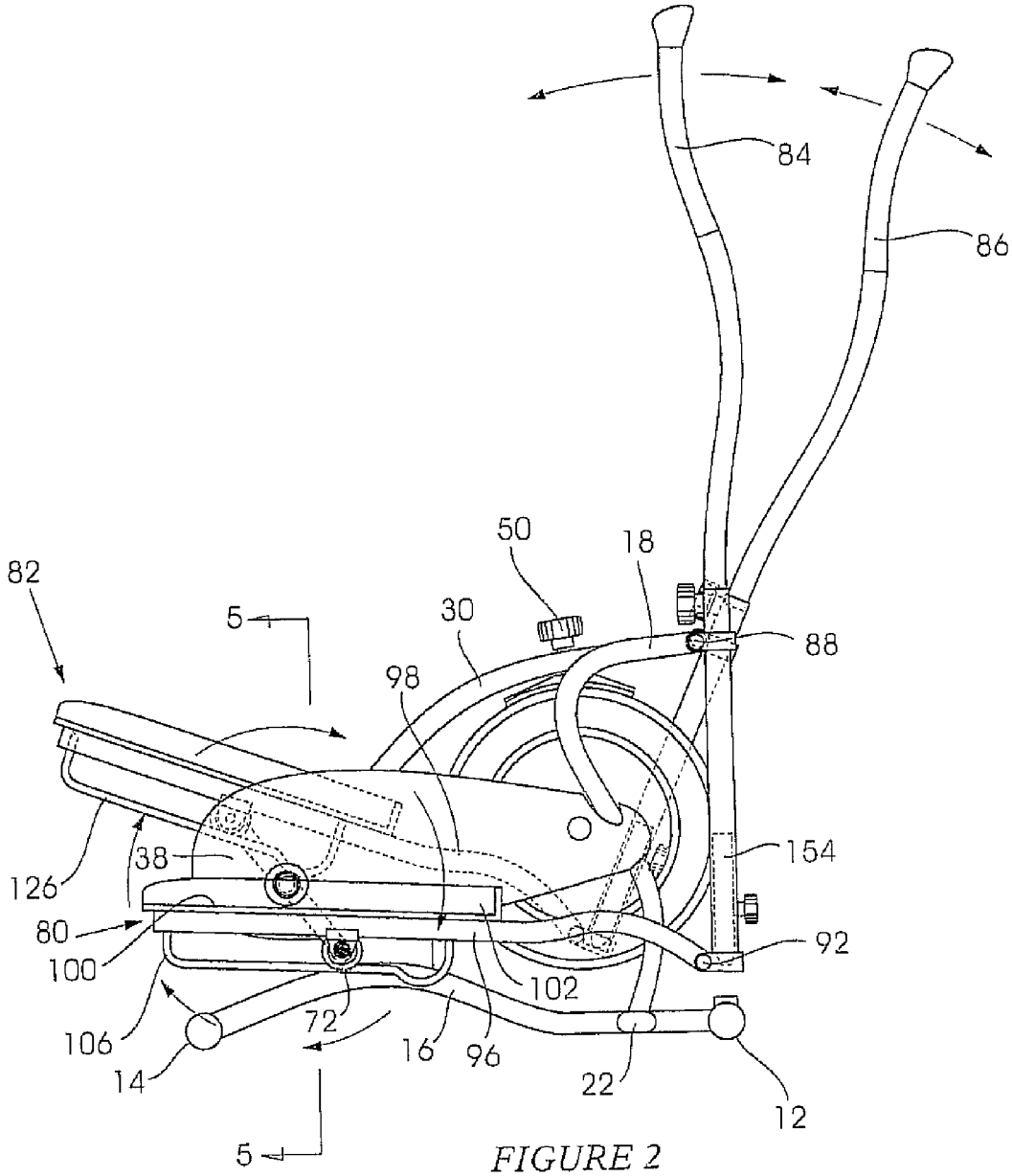
FIG. 2 shows the exercise machine of FIG. 1 in a second, elliptical mode of operation.

Two elongate handles 84 and 86 respectively are fixed at respective pivot points 88 and 90 to the crosspiece 24 (FIGS. 2 and 6). At lower ends the handles are pivotally connected at respective points 92 and 94 to cross members 96 and 98. The foot-engaging structures 80 and 82 are attached to respective upper surfaces of opposed ends of the cross members 96 and 98.

Each foot-engaging structure has a respective flat platform 100 with small upstanding peripheral flanges 102, which help to retain a user's foot engaged with the platform. The roller 72 is positioned on a lower side of the cross member 96 and is held engaged with the lower surface by means of a guide rod 106 which extends in a longitudinal direction of the cross member so that the roller 72, constrained by the crank member 64, can move freely to and fro on the underside of the cross member 96—see FIG. 3.

A bracket 108 is fixed to a side of the cross member 96 at a selected location and extends downwardly. The bracket is shaped so that it does not interfere with movement of the roller 72—see FIGS. 4 and 5. The bracket has a central fixing formation 110 in the form of a hole or passage.

On an opposing side the foot-engaging structure 82 has a platform 120 with peripheral formations 122, a guide rod 126, and a bracket 128 which has a hole 130.

A cog 140, shown in dotted outline in FIG. 1, is mounted to an axle which extends through the axis 62 and to which the crank members 64 and 68 are fixed. A chain 142, located inside the structure 38, connects the cog 140 to the cog 52.

The front base member 12 has two apertures 150 and 152 at opposing ends which directly underlie lower ends of the handles 84 and 86 respectively (see FIG. 6). Locking pins 154 and 156 are respectively positioned inside these lower ends. The pins are movable, in a controlled and regulated way by means of an actuator key as is described hereinafter between elevated positions in which the handles can move freely past the front base member and lowered positions at which the pins are engaged with the base members. Leading ends 162 of the pins, see FIG. 1, are tapered to facilitate entry of the pins into the holes 150 and 152 respectively.

With the exercise machine in the mode shown in FIG. 1, referred to herein as a stepping mode, the pins 154 and 156 are respectively engaged with the holes 150 and 152. The handles are thus effectively locked to the supporting structure and are constrained against pivotal movement around the respective pivot points 88 and 90. The pedal arrangement 60 on the other hand can be actuated by a user who is standing on the foot-engaging structures 80 and 82 and who grips upper ends of the handles 84 and 86. When pedal action takes place the rollers 72 and 74 rotate about the axis 62. The two platforms 100 and 120 do not rotate with the stub axles for they are fixed to the respective cross members 96 and 98 which can pivot about the respective points 92 and 94. The platforms thus rise and fall in respective vertical planes as the rollers are rotated, by the crank members, about the axis 62. This offers the user a stepping-type action with the user's feet moving substantially in vertical planes up and down.

To convert the machine to the second, elliptical mode, shown in FIG. 2, the locking pins 154 and 156 are raised and are held in elevated positions in a manner which is described hereinafter. The stub axles 66 and 70 are then aligned with the corresponding holes 110 and 130 in the respective brackets 108 and 128 (FIG. 4) and, by using interlock mechanisms 164 and 166, only notionally shown in FIG. 5, the stub axles are locked to the corresponding cross members 96 and 98.

When a user exerts a pedalling action the platforms 100 and 120 are rotated about the axis 62 (FIG. 2). The path which each platform follows is usually not truly circular and, for convenience, at least, is referred to herein as an elliptical path. This type of movement is permitted because the handles, and hence the cross-members, are detached from the front base member 12. The handles 84, 86 move to and fro, reciprocating in each instance about the respective pivot points 88 and 90. The user's feet rest on the respective platforms which are pivotally linked to the handles 84, 86 via the cross pieces 96 and 98. The feet are thus subjected to a compound motion which is a combination of the rotational crank movement and a sliding/reciprocating motion which is coupled to the reciprocating movement of the handles.

In each mode the user exerts energy on the exercise machine via the pedal arrangement. In the elliptical mode the user additionally is able to input energy via the handles 84 and 86.

Rotational movement of the pedal arrangement is translated into rotational movement of the flywheel 44 via the cogs 140 and 52 and chain 142 (FIG. 1). The flywheel thus exerts a resistance force which opposes movement of the pedal arrangement. The resistance force can be varied by means of the friction brake pad 48 to suit the requirements of an exerciser.

In the a foregoing description the stepping mode (FIG. 1) is produced by locking the handles to the front base member 12. The elliptical mode (FIG. 2) is achieved by fixing the stub axles 66, 70, at selected positions, to the platforms 100 and 120, via the cross-members 96 and 98. If the handles 84, 86 are locked to the front base member 12 and if the stub axles 66, 70 are fixed to the cross-members then no movement of the machine's components is possible. On the other hand if the handles 84, 86 are disengaged from the front base member 12 and, at the same time, the stub axles 66, 70 are disengaged from the platforms, then a potentially dangerous situation exists for movement of components of the exercise machine can take place in an unguided or unrestricted manner. To prevent this from occurring it is preferred to make use of an interlock mechanism 164, 166 which ensures that it is not possible for the handles to be freely pivotally movable about the pivot points 88 and 90 and, at the same time, for the rollers to be movable to and fro on the undersides of the respective platforms. FIGS. 7 to 15 illustrate how this type of interlocking capability is achieved.

FIGS. 7 to 11 illustrate in detail the operation of the interlock mechanism 164 in a zone of the exercise machine which lies in a circled area marked IM in FIG. 6. The interlock mechanism 164 is based on the use of an actuator key 180 which is shown in perspective in FIG. 7. The key has a shaft 182, a handle 184 fixed to one end of the shaft and a sleeve 186 fixed to an opposing end of the shaft. A pin 188 is fixed to and projects from the sleeve. A six-sided member 190 extends from an end of the sleeve which is remote from the handle 184.

Figure 8:
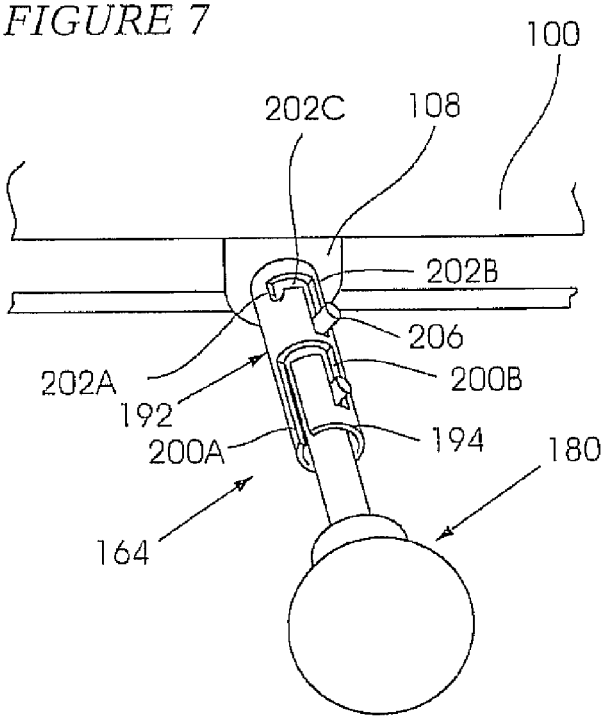
Figure 10:
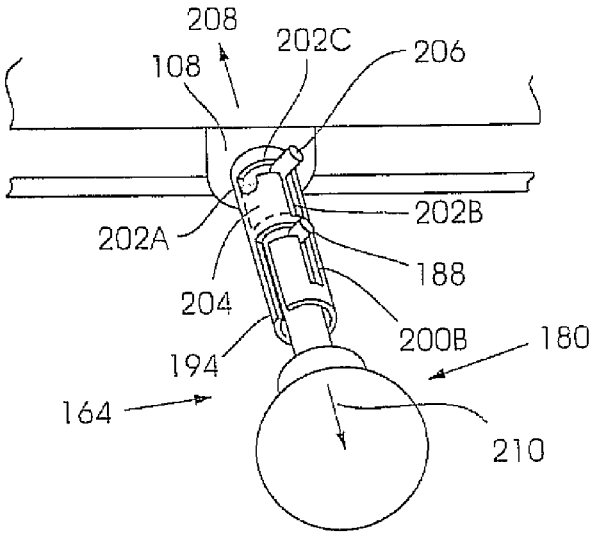
Figure 11:
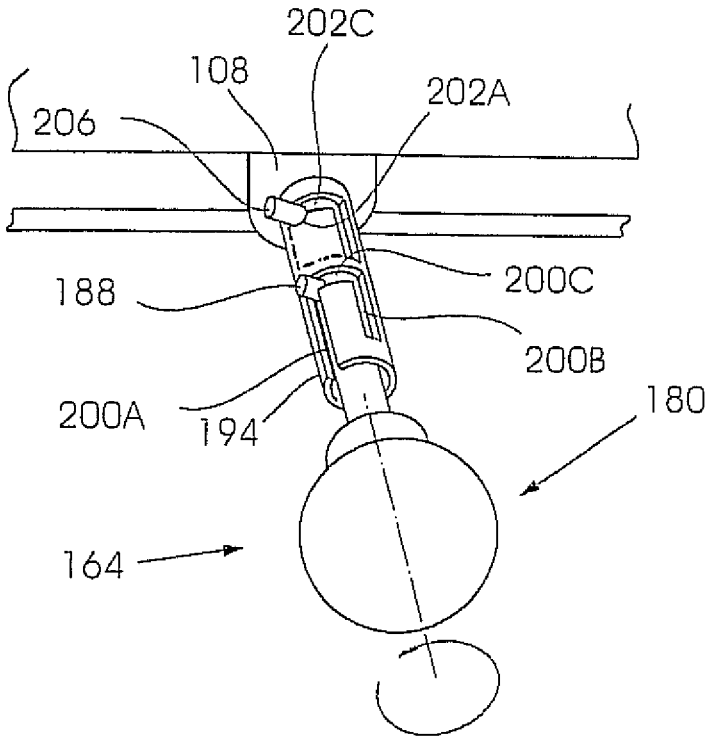

FIG. 8 shows the actuator key 180 engaged with an interlock component 192 which projects from the bracket 108. In this arrangement the machine 10 is in a stepper mode (FIG. 1). FIGS. 10 and 11 show two successive stages in the use of the actuator key 180 when the exercise machine is converted from the stepper mode to the elliptical mode (FIG. 2).

Figure 9:
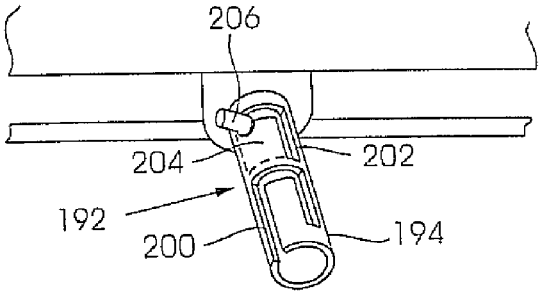

The interlock component 192 comprises a tube 194 which is formed with two hook-shaped slots 200 and 202 respectively (see FIG. 9). The pin 154 is replaced by a short rod 204 (which) is slidably positioned inside the tube 194. A spigot 206 extends from the rod 204. The rod is movable in a direction 208 (FIG. 10) against the action of a spring, not shown, mounted internally in the tube 194 to a position at which the roller 72 is locked to the bracket 108.

The slot 202 has a short limb 202A, a long limb 202B and a bridging section 202C. With the spigot 206 in the short limb 202A the rod 204 is kept projecting to a maximum extent from the tube and the bracket 108 is thereby coupled to the roller 72 (not shown). If the spigot 206 is moved to the long limb 202B then, under the action of the internal spring referred to, the rod 204 is movable inside the tube 194 in a direction 210 which is opposite to the direction 208. The rod 204 is thereby retracted and the roller is thereby disengaged from the bracket.

The slot 200 has a long limb 200A, a short limb 200B and a bridging section 200C. When the actuator key 180 is engaged with the tube 194 the pin 188 is guided for movement along the long limb 200A and then, with rotatable movement of the actuator key, through the bridging section 200C. The pin 188 can then be retracted slightly, while remaining captive to the tube, with the pin 188 moving inside the short limb 200B.

An end of the rod 204 which is positioned inside the tube 194 has a six-sided socket 212 which is of complementary shape to, and which is engageable with, the member 190. This allows rotational movement of the actuator key to be transferred to the rod 204.

FIG. 8 shows the actuator key 180 with the pin 188 in the short limb 200B. The spigot 206 is in the long limb 202B. This means that the rod 204 is in a retracted position and the roller 72 can be moved to and fro below the platform 100.

FIG. 10 illustrates the actuator key 180 pushed, in the direction 208, inwardly towards the platform. The pin 188 is moved to an extreme position inside the short limb 200B and the spigot 206 is moved by the same amount inside the long limb 202B. As shown in FIG. 11 the actuator key 180 is then rotated in an anticlockwise direction. The pin 188 then moves in the bridging section 200C and the spigot 206 moves in the bridging section 202C.

When the actuator key 180 is moved inwardly the rod 204 is moved to couple the roller 72 to the bracket 108. When the pin 188 reaches the long limb 200A it is possible for the actuator key 180 to be withdrawn from the tube 194. The rod 204 is not free to move in the same direction i.e. to a retracted position, because its movement is prevented by the spigot 206 engaging with a limiting surface of the short limb 202A. The rod 204 is thus held in a position at which the roller is fixed to the bracket i.e. the machine is now in an elliptical mode.

It is apparent that the actuator key 180 can only be disengaged from the tube 194 when the rod 204 is in an operative position i.e. with the machine in an elliptical mode.

The a foregoing description relates to one side of the exercise machine only. Corresponding movements are carried out on the interlock mechanism 166, on the opposing side of the machine, which is based on the use of a second actuator key 180A which in all material respects is the same as the actuator key 180.

FIGS. 12 to 15 show the use of the actuator key 180A, on the opposing side, to release the handle 86 so that it is free to pivot about the pivot point 90 when elliptical-type movement takes place.

A lower end of the handle 86, which is tubular, is formed with an elongate slot 220. At one end the slot terminates in a hook-shaped formation which defines a short slot 224 and a transverse slot 226. A tubular locking pin 156 projects from a lower end of the handle. This construction is shown, in context, in FIG. 6.

Figure 12:
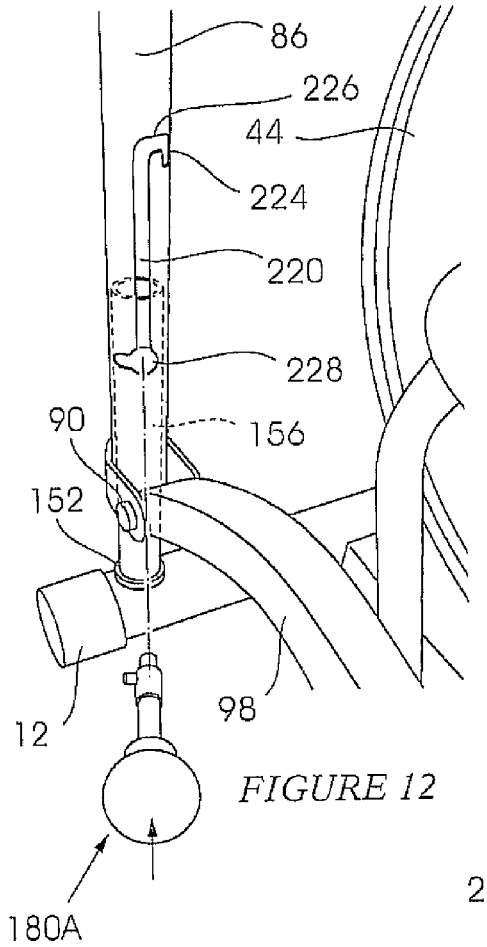
FIGS. 12 to 15 show the use of a similar actuator key, in connection with a handle of the exercise machine, in changing the exercise machine from the stepper mode to the elliptical mode.
Figure 13:
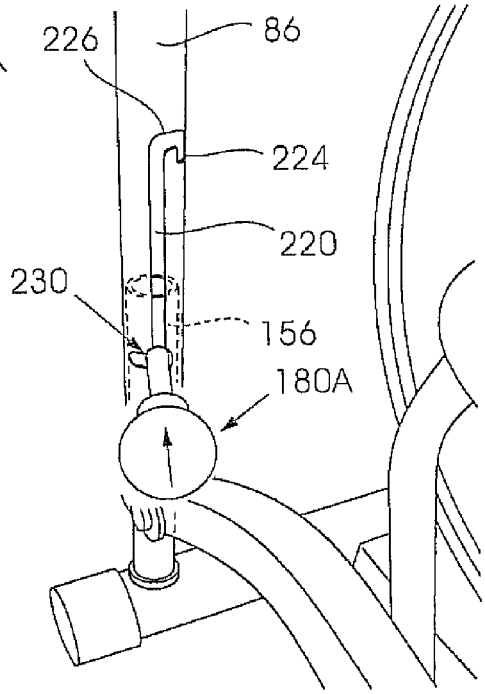
Figure 14:
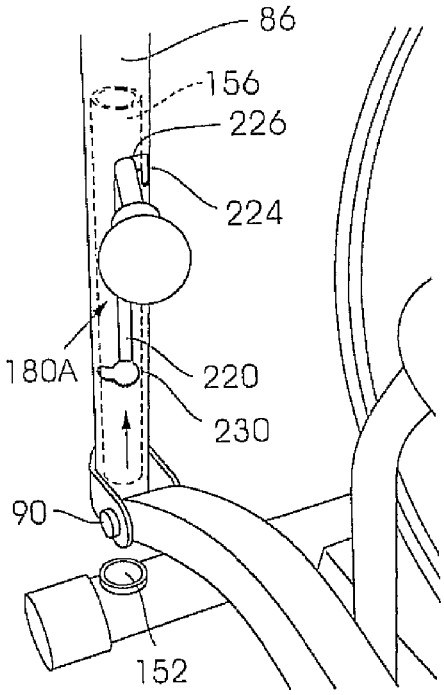

In FIG. 12 the pin 156 is engaged with the hole 152 in the front base member 12. The actuator key 180A is then aligned with an enlarged lower end 228 of the slot 220 and is inserted into the slot (FIG. 13). The actuator key passes through a corresponding aperture 230 which is formed through a wall of the pin 156. This pin is biased downwardly by means of a spring, not shown, located inside the handle.

Figure 15:
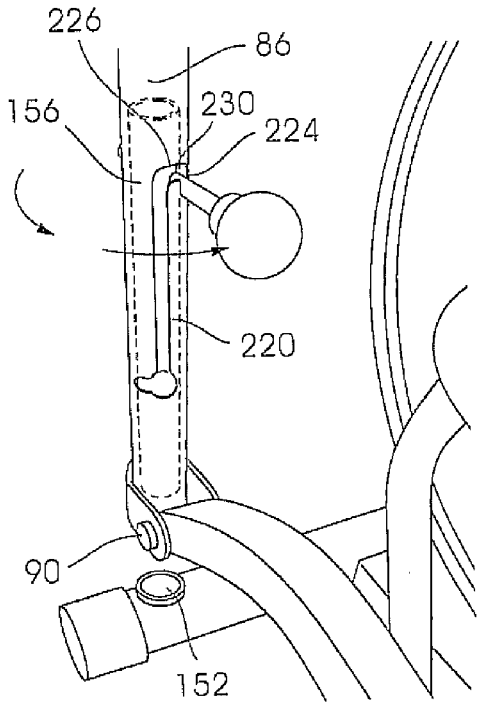

The actuator key 180A is then raised (FIG. 14) and moves along the elongate slot 220. The pin 156 is also raised and is thereby disengaged from the hole 152. At an upper limiting position the actuator key is moved along the transverse slot 226 to the short slot 224 and allowed to descend slightly. The actuator key 180A is then held at an elevated position and the locking pin is also kept elevated (FIG. 15). It is not possible for the actuator key 180A to be disengaged from the handle 86 unless the locking pin 156 is again engaged with the hole 152. A similar process is carried out on the other handle when the exercise machine is converted to the elliptical mode.

In summary and referring only to one side of the exercise machine, a single locking key is used to secure the handle to the front base member or to fix the roller to the bracket. The key can only be disengaged from the handle when the handle is engaged with the front base member. Similarly the key can only be disengaged from the bracket if the roller is engaged with the bracket. When conversion of the exercise machine from the stepper mode to the elliptical mode takes place the roller is first fixed to the bracket—this is while the handle is fixed to the front base member. With the roller fixed to the bracket the actuator key is removable and can then be used to release the handle from the front base member. The actuator key is then kept engaged with the handle. If conversion to the stepper mode is to take place the handle is first locked to the front base member and when this occurs the actuator key can be removed from the handle. Thereafter the actuator key is used to release the roller from the bracket but, when this occurs, the key is held captive as shown in FIG. 8. The key also has an unusual shape at its operative end i.e. the six-sided member and the projecting pin 188. It is therefore not possible, at least under normal conditions of usage, for the handle to be released from the front base member and at the same time for the roller to be released from the bracket.

The invention claimed is:

1. An exercise machine comprising:

a ground-engaging support structure;

a pedal arrangement which includes first and second crank members which are mounted to the support structure for rotational movement about a first axis;

first and second handles which are mounted to the support structure for pivotal movement about a second axis;

first and second cross members which are respectively pivotally connected to the first and second handles;

first and second foot-engaging structures, mounted respectively to the first and second cross members, which are respectively engaged with, and which are movable relative to, the first and second crank members;

first and second locking pins which are movable between respective operative positions and inoperative positions, wherein at the operative positions, the first and second locking pins lock the first and second handles to the support structure thereby to inhibit pivotal movement of the handles about the second axis so that, upon rotational movement of the pedal arrangement, the first and second foot-engaging structures are movable to provide a first exercise action and, in response thereto, the first and second cross members are pivotally movable relative to the first and second handles, and wherein with the first and second locking pins at the respective inoperative positions the pivotal movement of the handles is not inhibited; and first and second locking rods which are movable between respective operative positions and inoperative positions, wherein at the operative positions the first and second locking rods lock the first and second crank members to the first and second cross members respectively, so that, upon rotational movement of the pedal arrangement, the first and second foot-engaging structures are movable to provide a second exercise action and, in response thereto, the first and second handles are pivotally movable about the second axis, and wherein with the first and second locking rods at the respective inoperative positions the first and second crank members are not locked to the first and second cross members respectively.

2. An exercise machine according to claim 1, further comprising a resistance device which acts at least against rotational movement of the pedal arrangement.

3. An exercise machine according to claim 2, further comprising first and second guides which respectively retain the first and second foot-engaging structures in engagement with the first and second crank members.

4. An exercise machine according to claim 1, further comprising first and second guides which respectively retain the first and second foot-engaging structures in engagement with the first and second crank members.

5. An exercise machine according to claim 1, wherein the first exercise action is a stepping action and the second exercise action is an elliptical action.

6. An exercise machine according to claim 1, further comprising an actuator which is only engageable with the first locking pin and which is only disengageable from the first locking pin when the first locking pin is in its respective operative position and the first handle is locked to the support structure, and which is only engageable with the first locking rod and which is only disengageable from the first locking rod when the first locking rod is in its respective operative position, wherein, when the actuator is engaged with the first locking pin, the actuator is operable to move the first locking pin to its respective inoperative position, and when the actuator is engaged with the first locking rod the actuator is operable to move the first locking rod to its respective inoperative position.

* * * * *